United States Patent [19]

Snyder

[11] 4,108,274

[45] Aug. 22, 1978

[54] ACOUSTICAL APPARATUS

[75] Inventor: John R. Snyder, Fort Wayne, Ind.

[73] Assignee: Jet Aeration Company, Cleveland, Ohio

[21] Appl. No.: 702,581

[22] Filed: Jul. 6, 1976

[51] Int. Cl.[2] ..... F01N 1/00

[52] U.S. Cl. ..... 181/229; 181/243; 181/265; 181/268; 181/272

[58] Field of Search ..... 181/53, 54, 57, 35 A, 181/35 R, 63, 68, 67, 212, 217, 229, 233, 243, 249, 255, 264, 265, 269, 272, 268

[56] References Cited

U.S. PATENT DOCUMENTS

| | | | |
|---|---|---|---|
| 859,414 | 7/1907 | Smith | 181/63 |
| 1,023,644 | 4/1912 | Hall | 181/57 |
| 1,700,993 | 2/1929 | Bernet et al. | 181/53 |
| 1,772,589 | 8/1930 | Beamer | 181/57 |
| 2,576,522 | 11/1951 | Kyffin | 181/47 R |
| 2,765,044 | 10/1956 | Hatte | 181/47 R |

*Primary Examiner*—L. T. Hix
*Assistant Examiner*—Benjamin R. Fuller
*Attorney, Agent, or Firm*—Woodling, Krost, Granger & Rust

[57] ABSTRACT

An apparatus for reducing acoustical pressure in a tubing is disclosed comprising a first molded plastic member having a first support with an orifice extending therethrough and having a first side forming a substantially saucer shaped member. A plurality of first walls are molded into the first member to extend from the first support radially spaced about the orifice and interposed between the orifice and the first side. A second molded plastic member, which is smaller than the first member, includes a second support and a second side. A plurality of second walls extend from the second support radially spaced and interposed between the center of the second support and the second side. A tubing having acoustical pressure is receivable in the orifice of the first member. The first and second members are mounted to one another forming a labyrinth passage between the orifice and the first and second sides of the first and second members. The foregoing abstract is merely a resume of one general application, is not a complete discussion of all principles of operation or applications, and is not to be construed as a limitation on the scope of the claimed subject matter.

12 Claims, 6 Drawing Figures

ACOUSTICAL APPARATUS

BACKGROUND OF THE INVENTION

1. Field of the Invention

This invention relates to acoustical pressure and muffler assemblies and more particularly to apparatuses for reducing acoustical pressure in forced air sewage treatment systems.

2. Background of the Invention

The prior art has known many types of apparatuses commonly referred to as a muffler for reducing the acoustical pressure in a tubing. Muffler assemblies have been commonly used with internal combustion engines, forced air systems and the like. One particular application for a muffler apparatus is in a forced air sewage treatment system, particularly for residential use. In recent years, there has been a movement in population from the urban areas to the suburban and rural areas making the need for highly efficient home sewage treatment systems more prominent. Accordingly, the advantages of a forced air sewage treatment system has become more apparent with more stringent code requirements as a result of this population movement.

Many of the forced air home sewage treatment systems operated so efficiently that an audible air noise would accompany the aerating process. This air noise was undesirable to the home owner when the home sewage treatment system was installed near the living area. Heretofore, the prior art has not known of an acoustical apparatus which is specifically designed for reducing the undesirable audible sound of a home sewage treatment system.

Therefore, it is an object of this invention to provide an apparatus for reducing acoustical pressure in a sewage treatment system which may be mounted within the existing casting of a home sewage treatment system.

Another object of this invention is to provide an apparatus for reducing acoustical pressure in a sewage treatment system which is easy to install in existing sewage treatment castings and requires a minimum of maintenance.

Another object of this invention is to provide an apparatus for reducing acoustical pressure in a sewage treatment system including an expansion chamber having a labyrinth passage for interconnecting a forced air sewage treatment system with ambient air.

Another object of this invention is to provide an apparatus for reducing acoustical pressure in a sewage treatment system having first and second unitary members including first and second support means with wall means unitary with one of the first and second members and extending therefrom to form a labyrinth passage with the wall means upon mounting the first unitary member to the second unitary member.

Another object of this invention is to provide an apparatus for reducing acoustical pressure in a sewage treatment system having a first and a second unitary molded plastic member secured to one another with wall members mounted therein to form a labyrinth passage to reduce acoustical pressure.

Another object of this invention is to provide an apparatus for reducing acoustical pressure in a sewage treatment system which may be inexpensively formed from a molded plastic material.

SUMMARY OF THE INVENTION

The invention may be incorporated into an apparatus for reducing acoustical pressure in a tubing, comprising in combination, a first member having first support means with an orifice extending therethrough and first side means, a plurality of first wall means extending from said first support means radially spaced about said orifice and interposed between said orifice and said first side means of said first member, a second member having second support means and second side means, one of said first and second members being smaller than the other of said first and second members, a plurality of second wall means extending from said second support means radially spaced about and interposed between the center of said second support means and said second wall means, means for connecting one of said first and second members to the tubing, and means for mounting said first member to said second member with said first and second wall means forming a passage between said orifice and said first and second side means of said first and second members.

The invention may also be incorporated into a muffler apparatus, comprising in combination, a first unitary member having first support means and side means, a second unitary member having second support means, wall means unitary with one of said first and second unitary members and extending therefrom, one of said first and second unitary members having an orifice, and means for mounting said first unitary member to said second unitary member in cooperation with said wall means to form a labyrinth passage between said orifice and said side means.

Other objects and a fuller understanding of the invention may be had by referring to the following description and claims, taken in conjunction with the accompanying drawings.

DESCRIPTION OF THE PREFERRED EMBODIMENT

Figure 1:
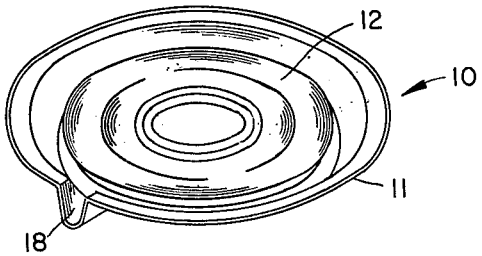
FIG. 1 is a perspective view of the preferred embodiment of the invention.
Figure 2:
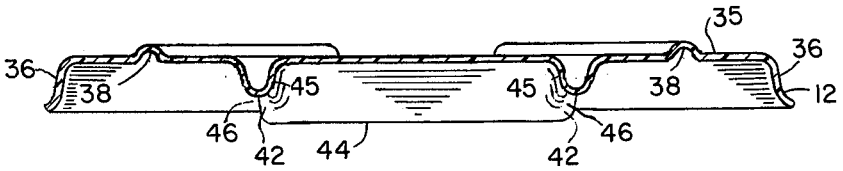
FIG. 2 is a side sectional view of the upper member of the invention shown in FIG. 1.
Figure 3:
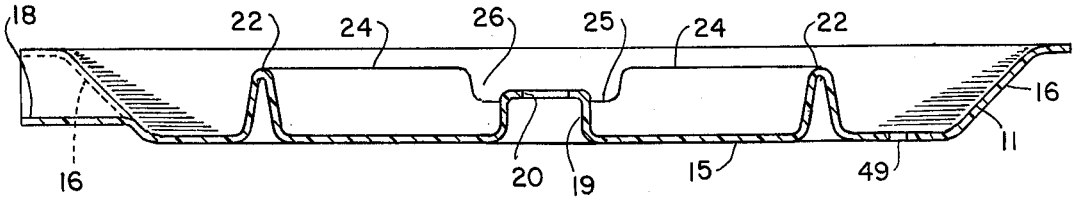
FIG. 3 is a side sectional view of the lower member of the invention shown in FIG. 1.
Figure 4:
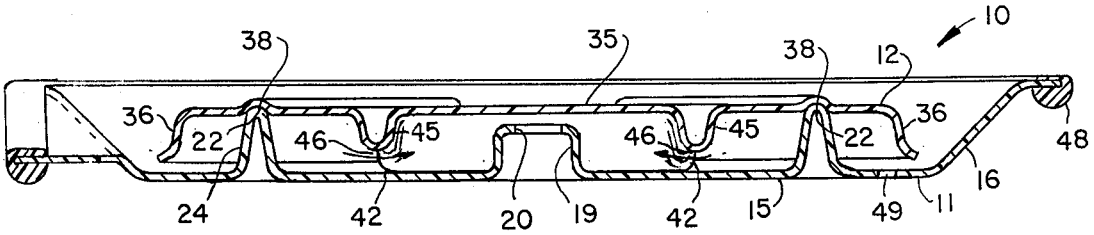
FIG. 4 is a side sectional view of the assembly of the upper and lower members shown in FIGS. 2 and 3.
Figure 5:
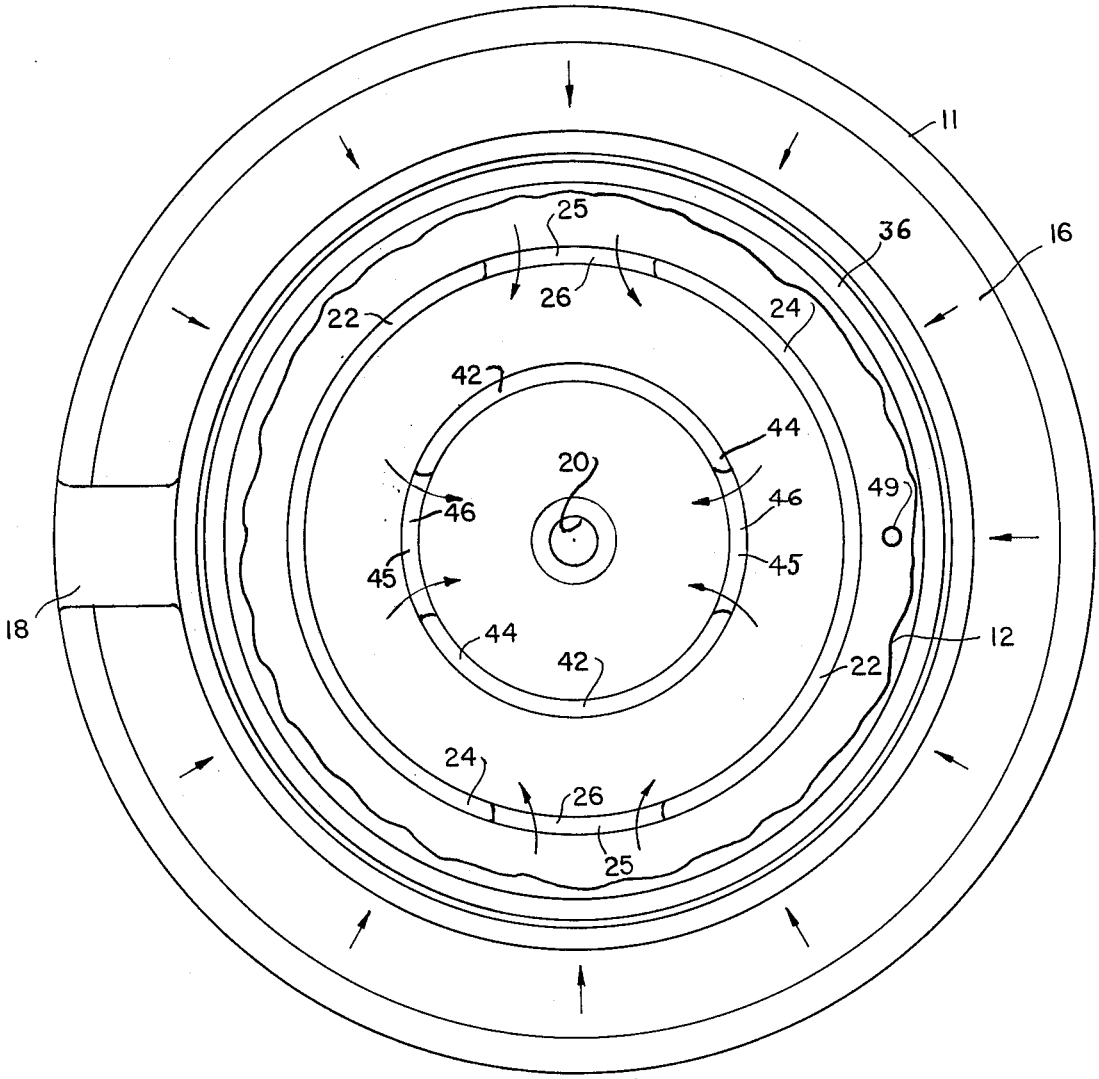
FIG. 5 is a top view of the assembly shown in FIG. 4.
Figure 6:
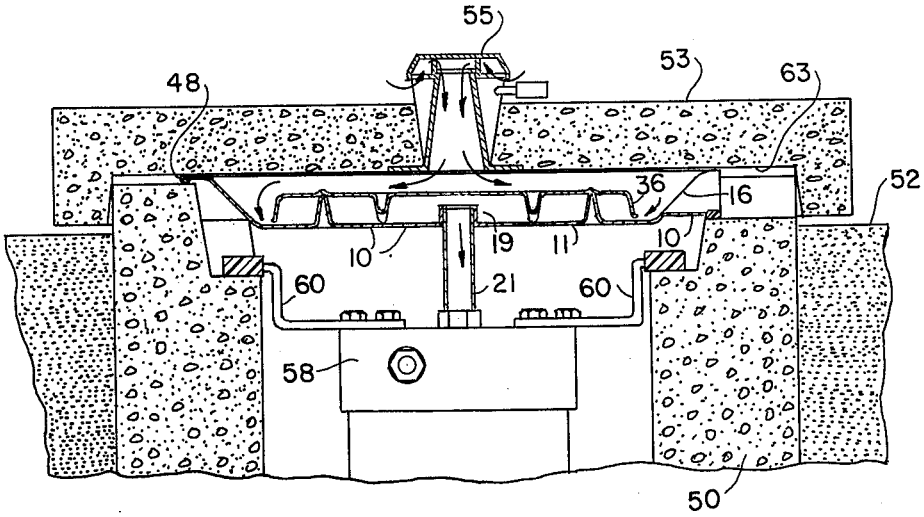
FIG. 6 is a side sectional view of a portion of a home sewage treatment system incorporating the invention shown in FIGS. 1–5.

FIG. 1 is a perspective view of an acoustical apparatus 10 for reducing acoustical pressure comprising a first lower unitary molded plastic member 11 shown in side section in FIG. 3 and a second upper unitary molded plastic member 12 shown in side section in FIG. 2. FIG. 4 illustrates a side sectional view of the assembly of the first and second (lower and upper) members 11 and 12 whereas FIG. 5 illustrates a top view of the assembly shown in FIG. 4. The first member 11 includes first support means 15 and first side means 16 forming a saucer shaped member. An aperture 18 cooperates with a casting of a state of the art home sewage treatment system as shown in FIG. 6. The first support 15 includes a recess 19 located in the approximate center of the first support 15 with an orifice 20 extending through the first support 15. The recess 19 is adapted to receive a tube 21 as shown in FIG. 6 for communication to the internal portion of the apparatus 10.

A plurality of first wall means 22 are molded into the first support 15 to extend therefrom and are interposed between the sides 16 and the orifice 20. The first wall means 22 comprises a first major wall 24 and a first minor wall 25 which are sequentially and uniformly spaced about the orifice 20 as shown in FIG. 5 creating spaces 26 which form a portion of a labyrinth air passage as will be here in after described.

The second member 12 comprises second support means 35 and second side means 36. Wall receiving means 38 shown as integral molded slots in the second support 35 cooperate with the first wall means 22 of the first member 11 as shown in FIG. 4 to locate the first member 11 relative to the second member 12. A plurality of second wall means 42 are molded into the second support 35 to extend therefrom and are interposed between the sides 36 and the center of the second support 35. The second wall means 42 comprise second major wall 44 and a second minor wall 45. The second major and minor wall, 44 and 45, are uniformly spaced about the center of the second support 35 creating spaces 46 which form a portion of the labyrinth passage.

FIGS. 4 & 5 illustrate sectional and top views of the assembled apparatus shown in FIG. 1. The first member 11 is secured to the second member 12 by appropriate means such as gluing or ultrasonic welding with the wall receiving means 38 of the second member 12 receiving the first wall means 22 of the first member 11. Accordingly, the spaces 26 and 46 are oriented 90° from one another creating a labyrinth air flow passage extending between the orifice 20 and an area between the first and second sides 16 and 36. The first wall means 22 extend from the first support 15 a greater distance than the second support means 42 extends from the second support 35. This arrangement enables the first and second wall means 22 and 42 to substantially contact the second and first support, 35 and 15, of the second and first members, 12 and 11, respectively.

The first and second walls 22 and 42 are spaced from the center of the first and second members, 11 and 12, a first and a second distance. The arrangement of the first and second walls create a baffle which cancels and absorbs undesirable audio emission.

A gasket 48 is secured to the sides 16 of the first member 11 for mounting the apparatus 10 to a sewage treatment system as will hereafter be described. An aperture 49 in the first member 11 allows drainage of any accumulated water in the apparatus 10.

The cutout second member 12 in FIG. 5 more clearly shows the air flow passage between the first and second sides 16 and 36 substantially surrounding the orifice 20. The air enters the space radially outward from the first walls 22 and flows through spaces 26 adjacent the first minor walls 25 to enter the space radially outward from the second walls 42. The air flows through spaces 46 adjacent the second minor walls 45 to enter the center of the apparatus 10 to exit through orifice 20. The apparatus may function with an air flow in the reverse direction.

FIG. 6 is a side sectional view with portions thereof in full of a portion of a home sewage treatment system comprising a cement casting 50 installed in the earth 52 and including a cover 53 having an air vent 55. The detailed structure of the air vent 55 is disclosed in U.S. Pat. No. 3,884,134 and is hereby incorporated by reference. A motor 58 provides motive power for forced air flow to the bottom of the casting 50 and is secured to the casting 50 by supports 60. The tubing 21 transports air input to the lower portion of the casting as is well known to the art. The recess 19 of the first member 11 receives tubing 21 to support the apparatus 10 relative to the motor 58. The gasket 48 seals with the underside 63 of the cover 53 when placed on the casting as shown. Removal of the cover 53 enables inspection and cleaning of the apparatus 10 which may be removed from tubing 21. The air flow in this embodiment enters the casting 50 through the vent cap 55 as shown by arrows and is drawn into the apparatus between the side means 16 and 36 of the first and second members 11 and 12. The air flow continues through the passage of the apparatus to enter tubing 21. The apparatus 10 eliminates objectional audible sound caused by the movement of air.

The invention has been described as an apparatus for reducing acoustical pressure in a tubing associated with a home sewage treatment system. Although the invention finds significant applications in this area, the foregoing description has been used by way of example of a perferred form of use and is not to be construed as a limitation on the claim subject matter or to the use of the invention.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and the scope of the invention as hereinafter claimed.

What is claimed is:

1. An apparatus for reducing acoustical pressure at a tubing, comprising in combination: a first member having first support means with an orifice extending therethrough and first side means; a plurality of first wall means extending from said first support means and extending annularly about said orifice and interposed between said orifice and said first side means of said first member; a second member having second support means and second side means; one of said first and second members being smaller than the other of said first and second members; a plurality of second wall means extending from said second support means and extending annularly about the center of said second support means and interposed between the center of said second support means and said second side means; means mounting said first member to said second member with said first and second wall means forming a passage between said orifice and an opening formed between said first and second side means of said first and second members; and means for connecting one of said first and second members to the tubing with one of said orifice and said opening formed between said first and second side means being in communication with the tubing when connected.

2. An apparatus as set forth in claim 1, wherein said connection means includes a recess in one of said first and second support means for receiving the tubing.

3. An apparatus as set forth in claim 1, wherein said mounting means includes a wall receiving means in one of said first and second members for cooperation with said plurality of wall means of the other of said first and second members;

4. An apparatus as set forth in claim 1, wherein said plurality of wall means of one of said first and second support means extends therefrom a greater distance than said plurality of wall means extends from the other of said first and second support means.

5. An apparatus as set forth in claim 1, wherein said wall means extend from one of said first and second support means a greater distance than said wall means extend from the other of said first and second support means.

6. An apparatus as set forth in claim 1, wherein each of said first and second support means is substantially circular in shape.

7. An apparatus as set forth in claim 1, including aperture means in said side means of one of said first and second members.

8. An apparatus as set forth in claim 1, wherein said plurality of first and second wall means includes first and second major wall means and first and second minor wall means, respectively;

said major wall means extending from said support means a greater distance than said minor wall means;

said first and second major and minor wall means sequentially forming a complete wall about the center of said first and second support means and at a first and second distance therefrom, respectively; and said mounting means including said first and second major wall means substantially contacting said second and first support means creating said passage in spaces between said major wall means.

9. An apparatus as set forth in claim 1 wherein said plurality of first wall means are uniformly spaced about and at a first distance from the center of said first support means; said plurality of first wall means being separated by a plurality of first spaces; said plurality of second wall means being uniformly spaced about and at a second distance from the center of said second support means; said plurality of second wall means being separated by a plurality of second spaces; and said mounting means locating said first spaces out of alignment with said second spaces thereby creating a labyrinth passage between said orifice and said opening formed between said first and second side means.

10. A muffler including in combination first and second generally dish shaped members, said first member having an outer circumferentially extending first side means having a first height and an orifice extending through a central portion thereof, said first member having a first passage defining wall means extending circumferentially around said orifice and having a smaller diameter than said first side means and having a radially extending opening therethrough, said first passage defining wall means having a height less than said first height, said second member being mounted to said first member in an inverted position with respect thereto and being supported by engagement with said first passage defining wall means, said second member having an outer circumferentially extending second side means having a height less than the height of said first passage defining wall means and a diameter intermediate the diameters of said first side means and said first passage defining wall means, said second member having a second passage defining wall means extending circumferentially around said orifice in said first member and having a smaller diameter than said first passage defining wall means and a height so as to be located closely adjacent said first member, said second passage defining wall means having a radially extending opening therethrough.

11. A muffler as claimed in claim 10 wherein means are provided on said first member to secure the same to a conduit with said orifice connected to the conduit.

12. A muffler as claimed in claim 10 wherein said radially extending openings in said first and second passage defining wall means are out of alignment.

* * * * *